US006233742B1

(12) United States Patent
Yungkurth

(10) Patent No.: US 6,233,742 B1
(45) Date of Patent: May 22, 2001

(54) GLOVE WITH REVERSIBLE LINER STORAGE POCKET

(75) Inventor: Kristin E. Yungkurth, Brooklyn, NY (US)

(73) Assignee: Aquarius Ltd., St. Louis, MO (US)

( * ) Notice: Subject to any disclaimer, the term of this patent is extended or adjusted under 35 U.S.C. 154(b) by 0 days.

(21) Appl. No.: 09/441,101

(22) Filed: Nov. 16, 1999

(51) Int. Cl.[7] ..... A41D 19/00
(52) U.S. Cl. ..... 2/160; 2/164; 2/250
(58) Field of Search ..... 2/16, 20, 159, 2/160, 161.1, 161.6, 247, 250, DIG. 2, 69, 164; 15/227

(56) References Cited

U.S. PATENT DOCUMENTS

| | | | | |
|---|---|---|---|---|
| 4,351,066 | * | 9/1982 | Pearsall | 2/85 |
| 4,485,917 | | 12/1984 | Smith . | |
| 4,670,909 | * | 6/1987 | Forrester | 2/160 |
| 4,787,376 | | 11/1988 | Eisenberg . | |
| 4,862,521 | * | 9/1989 | Mann | 2/160 |
| 4,933,992 | * | 6/1990 | Kallman | 2/160 |
| 4,937,881 | * | 7/1990 | Heise | 2/16 |
| 4,959,881 | * | 10/1990 | Murray | 15/227 |
| 5,244,278 | * | 9/1993 | Robitaille | 383/4 |
| 5,299,243 | | 3/1994 | Picco . | |
| 5,312,134 | | 5/1994 | Goode et al. . | |
| 5,367,712 | | 11/1994 | Smith et al. . | |
| 5,398,344 | * | 3/1995 | Hirano | 2/159 |
| 5,435,008 | | 7/1995 | Shane . | |
| 5,438,708 | * | 8/1995 | Jacovitz | 2/161.6 |
| 5,454,601 | | 10/1995 | Sekine et al. . | |
| 5,704,670 | * | 1/1998 | Surplus | 294/25 |
| 5,740,554 | * | 4/1998 | Reed | 2/158 |
| 5,785,396 | | 7/1998 | Israel . | |

FOREIGN PATENT DOCUMENTS

| | | | | |
|---|---|---|---|---|
| 0111634 | * | 6/1984 | (JP) | 2/78 |

* cited by examiner

*Primary Examiner*—John J. Calvert
*Assistant Examiner*—Katherine Moran
(74) *Attorney, Agent, or Firm*—Howell & Haferkamp, LC

(57) ABSTRACT

A pair of gloves includes one of the two gloves having a reversible storage pocket or bag affixed between an exterior shell and an inner liner with a zippered closure. When stored within the glove, the gloves may be used as is normal. When the user is ready to remove and store the gloves, the zipper may be opened and the storage bag reversed out from between the shell and liner to form a storage bag within which the same glove as well as its matching free pair member may be folded into and the same zipper re-closed to carry both gloves within the storage bag. One or more belt straps or loops may be provided on the exterior of the storage bag to allow it to slipped onto a belt or the like.

14 Claims, 2 Drawing Sheets

GLOVE WITH REVERSIBLE LINER STORAGE POCKET

BACKGROUND OF THE INVENTION (1) Field of the Invention

The present invention is related to a hand wearing apparel and more specifically gloves, where the gloves are fitted with an attached storage bag. The attached storage bag allows the wearer to stow the gloves and keep the set of gloves together. The storage bag is portable and accessible so when the wearer wishes to deploy the gloves, the wearer is able to quickly and easily remove the gloves from the bag and don the gloves. The bag is then internally stowed within a pocket in the glove.

(2) Description of the Background

Gloves are an essential article of clothing when the temperature begins to fall. However, they are often an article of clothing frequently removed by the wearer to perform intricate operations with their fingers that cannot be accomplished with gloves. At these times the wearer will remove the gloves, perform the operation, and re-don the gloves. Other times the wearer will find themselves in a transitional outdoor climate where wearing gloves may be comfortable at times, but at other times wearing gloves is undesirable. It is during the period when the gloves are removed that the wearer must decide what to do with their gloves. When gloves are worn they are easy to care for and keep track of. However, when they are removed, gloves are an extra article of clothing that are preferably stored and held without unduly encumbering the wearer. Often this storage, either long term or temporary, detracts from using gloves so that a potential wearer may choose to forgo their use.

When gloves are doffed by the wearer, the wearer expends some effort to keep the gloves together and out of the elements. Clips located on the side of the gloves allow the wearer to clip the gloves together, and then clip the bunch of gloves to an outer garments, such as a coat, a pant loop, or a zipper loop. This permits temporary storage of the gloves while freeing up the wearer's hands to engage in other activities. However, these clips allow the gloves to dangle from the wearer's coat or pants, where the gloves often project outward from the wearer's body. In this position, the gloves are sometimes an obstacle and danger as they are capable of snagging on objects around the user. Often when the gloves are caught on an object, these clips stretch or break under the strain of load, and the loss of one or more gloves or damage to the gloves is a common occurrence.

Clips for the gloves are often placed on the cuff of the glove away from the fingers. When clipping gloves together and then to the wearer's outer garments, the gloves often rotate so that the opening for the hand is oriented upward. This exposes the opening to the elements, where snow or rain could enter the hand opening of the glove and cause the inside to dampen.

Several other articles of clothing are similar to gloves in that they are frequently donned and doffed as the climate changes. Similarly with these articles during the period when the articles are doffed, the articles require storage. In the prior art, a hood on a coat is one type of article that is frequently alternately worn and removed. In some designs, the hood is unveiled through a pouch or pocket in the collar of the coat, so it is almost immediately retrievable upon demand. Also, some outer garments like a poncho or other rain gear are capable of being folded up into their own self fashioned pouch or pocket and stored for quick retrieval when required. However, these articles of clothing are generally flat with large areas to permit fashioning of a pouch or pocket to accept the garment. On the other hand, gloves are generally less bulky and without large surface areas to create a pocket or pouch. With the advent of light-weight protective, thin walled, insulating fabrics used in outer garments, the general bulkiness for these outer garments has decreased while the general insulating capability has been raised. The inventor has successfully used these materials to create a set of gloves, which is an improvement to the prior art.

To overcome these disadvantages of the prior art with respect to gloves, what is needed is a method of storing gloves so that the gloves are not exposed to the elements but are yet easily retrievable when desired by the wearer. Another object of this invention is to maintain the integrity of a set of gloves so the individual gloves do no become accidentally disassociated. Yet another object of the invention is to create a pocket in the glove for the protective storage of small personal items. Yet another object of the invention is to create a small, compact, individual storage unit containing a set of gloves.

SUMMARY OF THE INVENTION

The present invention is comprised of a storage bag fashioned into a liner of a glove, with a closure such as a double sided zipper for sealing its opening. The storage bag is preferably permanently sewn or otherwise located inside the glove, and is "invisible" when the gloves are worn by the wearer. When the wearer removes the gloves, the closure may be opened and the storage bag "reversed" out of the glove liner. The free glove may then be paired with the other glove and the two are then folded together and inserted into the storage bag. The zipper may then be closed from its other side to self contain the glove pair inside the bag. The bag is also preferably fitted with belt loops to allow the wearer to affix the storage bag to a belt or purse strap of the like.

When the wearer wishes to ready the gloves for donning, the wearer simply unzips the closure, withdraws the free glove from inside the bag, reverses the other glove, and then re-zips the closure. The storage bag is thus safely sealed away, is unobtrusive, and yet ready for use when glove storage is desired.

DETAILED DESCRIPTION OF THE INVENTION

Figure 1:
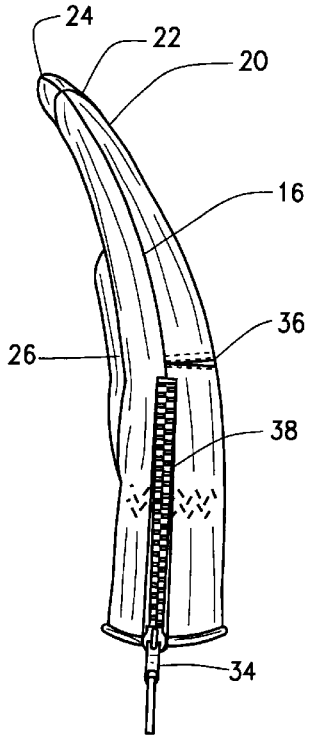
FIG. 1 is a side view of the left-hand glove detailing the zippered storage bag.

The hand apparel of this invention is indicated generally in FIGS. 1 through 5. FIGS. 1 through 5 show the various stages of the gloves as they are moved from the deployed state where the wearer has just removed the gloves to the stowed state where the gloves are fully contained within the storage bag 12. The invention comprises a glove, preferably a pair of gloves, one of which has a storage bag 12. However, a mitten or other hand wearing apparel may be configured as described below. The term glove will be used generally to describe any sort of hand wearing apparel. FIG. 1 shows a side view of the glove with a zippered opening 14 sewn into the pinky finger side 16 of the glove. The matching glove 18 in the set or the right hand glove preferably does not have a storage bag 12 although it is entirely possible to construct the right hand glove with the same features of the left-hand glove, either instead of or in addition to the left hand glove, without departing from the scope of the invention. In this embodiment of the invention only the left-hand glove of the pair has a storage bag. This description will describe in detail the construction of the left-hand glove, and for the purposes of this discussion the glove fitted with the storage bag 12 will be termed the storage glove 20.

The storage glove 20 and the matching glove 18 are preferably constructed with an external shell 22, made from a water repellant material as determined by the wearer's intended use. The storage glove 20 is also preferably constructed with a lining inner surface, which is generally a thin-walled insulating material with absorbent materials present on the hand (skin) side of the lining and a water repellant coating on the external-shell 22 side of the lining. The lining inner surface of the glove is preferably attached to the shell at the finger tip 24 and in the palm region 26 so that the lining surface does not pull away from the shell as the wearer removes the storage glove 20 from his hand.

Figure 1A:
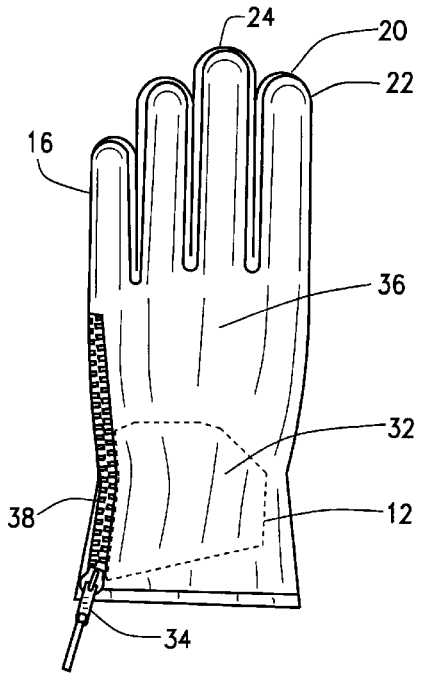
FIG. 1A is a plan view of the left hand glove, showing the storage bag in phantom, flattened within the lining when not in use.
Figure 2:
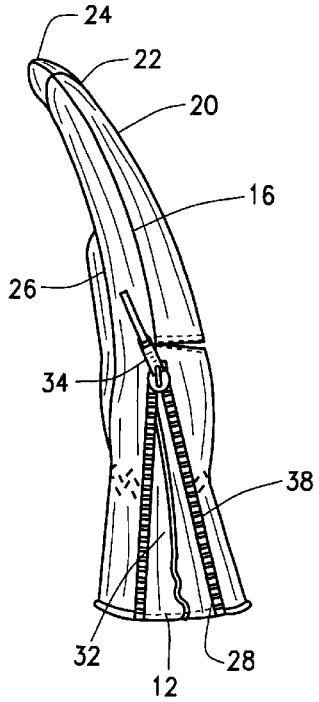
FIG. 2 is a side view of the left-hand glove with the storage bag unzipped.

In the region between the external shell 22 of the storage glove 20 and its inner lining surface, the storage bag 12 is positioned as the storage bag 12 is stored. The storage bag 12, comprised of a rim 28 with an inner surface 30 and an outer surface 32, is attached to an opening 14 in the side of the storage glove 20. This is shown in FIG. 1, 1A, and 2 where the storage bag 12 is located at the inside of the zipper opening 14 on the glove 20. The opening 14 in the storage glove 20 is positioned at the pinky finger side 16 so the storage bag 12 and the opening 14 are not within the common area between the two hands, and faces away from the user as he rotates his wrist in normal fashion. However, it is possible to construct a glove with the opening 14 in the knuckle region 36 of the glove, or some other region, without departing from the scope of the invention. The entire periphery of the rim 28 of the storage bag 12 is sewn to the opening 14 so that the storage bag 12 may be "reversed" into and out of the opening 14 on the storage glove 20. In FIG. 1, 1A, and 2, the opening 12 is outlined and closed by a zipper 34. The rim 28 of the storage bag 12 is also attached to the flat edges of the zipper 34. In the preferred embodiment, a zipper 34 is used at this opening; however, other suitable fabric fastener devices such as Velcro® could be used without departing from the scope of the invention.

The storage bag 12 with the bag in this internal position serves as a pocket 38. Thus by unzipping the storage glove 20 as in FIG. 2, but without reversing the storage bag out of the liner, the outer surface 32 of the storage bag 12 is exposed to uncover an internal pocket 38. With the storage bag 12 inserted into the storage glove as shown in FIG. 2, this zippered pocket 38 forms a sealable compartment that can be used to store small personal items, preferably flat such as a secret note or the like. The outer surface 32 of the storage bag 12 extends internally in the storage glove 20 as is shown by the shaded region in FIG. 1A. The storage bag 12 extends toward the knuckle region 36 of the hand, and is preferably placed between the external shell 22 and the lining of glove 20. Note that with this positioning of the storage bag 12, the hand will be free to grip items in the palm 26 of the glove without interference from the storage bag 12. Preferably affixed to the outer surface 32 of the storage bag 12 is a plurality of loops 40 for attaching the storage bag 12 to the belt of the wearer.

Figure 3:
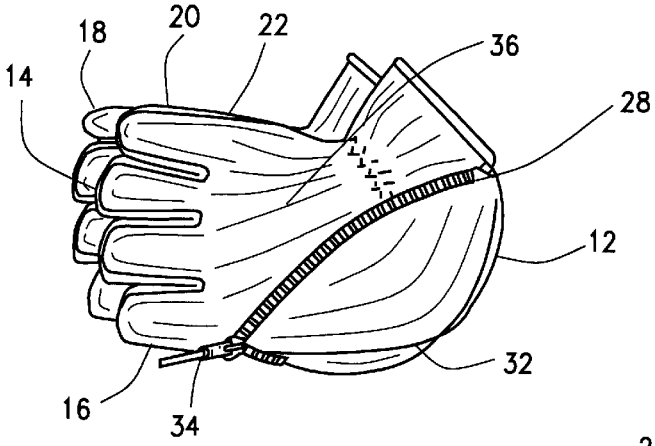
FIG. 3 is side view of the storage bag as it is beginning to be withdrawn from the liner.

As shown in FIG. 3, the outer surface 32 of the storage bag 12 is extended from the storage glove 20. As the rim 28 of the storage bag 12 is stitched to the zipper 38 edges, the storage glove 20 can be folded into the storage bag 12, in effect turning the storage glove 20 inside-out or reversed as the storage glove 20 is folded into the interior surface of the storage bag 30. The matching glove 18 is preferably positioned side-by side with the storage glove 20 and both gloves are then folded together into the inside surface 30 of the storage bag 12. The inside 30 of the storage bag 12 is accessible only to the internal surfaces of the storage glove 20, so that as the storage glove 20 is folded into the bag 12, the exterior shell 22 of the storage glove 20 becomes the inside surface 30 of the storage bag 12.

The positioning and configuration of the zipper 34 permits the same zipper 34 to seal the pocket 38 and seal the storage bag 12 depending on whether the gloves are deployed or stored. The zipper 34 is capable of zipping in either an external condition when the storage bag 12 is inserted into the pocket 38 or in an internal condition when the gloves 18, 20 are inserted into the storage bag 12.

Figure 4:
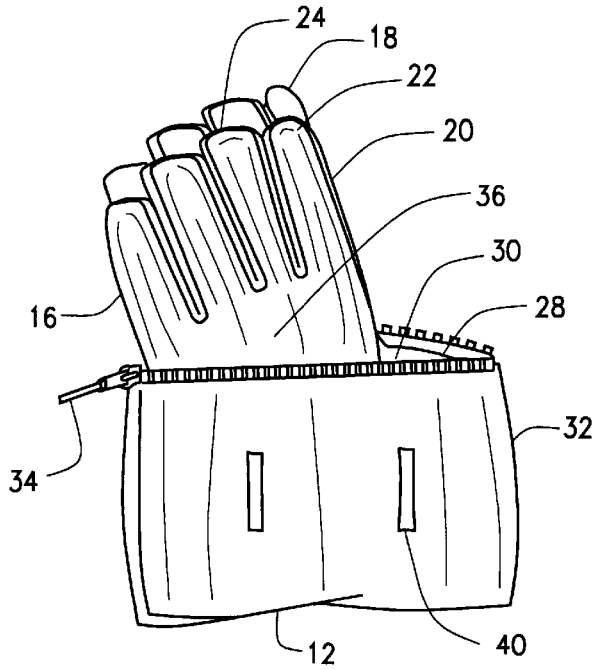
FIG. 4 is a side view of the storage bag fully reversed out of the liner and with the gloves almost fully inserted thereinto.
Figure 5:
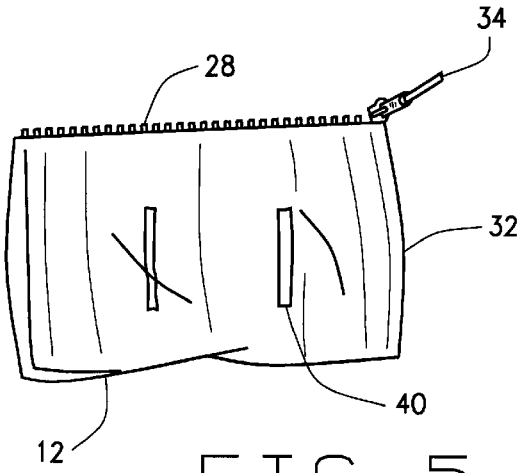
FIG. 5 is a side view of the storage bag with the gloves fully contained therein and the zipper closed.

FIGS. 4 and 5 show the gloves 18, 20 being inserted into the storage bag 12. To ease insertion of the pair of gloves 18, 20 into the storage bag 12, the wearer preferably folds and rolls the gloves 18, 20 into a ball as the gloves 18, 20 are pushed through the rim 28 of the storage bag 12 into the inner surface 30 of the storage bag 12. Once fully inserted, the bag 12 can be sealed using the zipper 34, and the storage bag 12 can be positioned as a compact package for stowage in a pocket, on a belt loop using the loops 40 of the outer surface 32 of the bag, on a purse strap, or as otherwise desired by the wearer. Any moisture, stain, or other dirt or the like accumulated on the outer surface of the storage bag as the gloves are stored therein will not adversely affect the insulating ability of the liner as such will be contained within the pocket formed by the bag 12 when it is reversed into the back of the glove. Moreover, the gloves 18, 20 are reliably kept together as a pair with a reduced risk of losing only one of the pair.

While this invention has been described in detail in the drawings and in the foregoing description in terms of its preferred embodiment, it will be recognized that many changes and modifications will occur to those skilled in the art. It is therefore intended to include any such changes and modification as fall within the true spirit and scope of the invention as defined by the appended claims and their legal equivalents.

What is claimed is:

1. At least one of a pair of gloves comprising:

a shell;

a lining disposed within said shell;

a reversible storage bag being affixed to lie between said shell and lining when said glove is being normally used, said storage bag being affixed within said lining of said glove so that upon reversing said storage bag from within said lining, the glove may be folded thereinto; and a closure for said storage bag so that said storage bag may be closed as said glove is being normally used and also closed as said storage bag is being used to contain said glove.

2. The glove of claim 1 wherein said storage bag is located to lie along the top of the back of the hand as the glove is worn.

3. The glove of claim 2 wherein said storage bag is attached to said glove solely at its opening and where the closure is attached.

4. The glove of claim 3 further comprising a second glove to complete the pair, the storage bag being sufficiently large to contain both of said pair as said first glove is folded into said storage bag.

5. A glove comprising:

an outer shell;

an inner lining disposed within said outer shell;

a self contained storage bag being fitted within the outer shell and the inner lining as the glove is used in its ordinary manner, said storage bag being deployable from a first stored position where it does not interfere from the use of the glove in its ordinary manner and a second exposed position where it is available for receiving therewithin the glove by its being folded thereinto; and a closure for an opening of said storage bag, said closure being exposed and operable in either of its first and second positions.

6. The glove of claim 5 wherein said storage bag is affixed to said glove solely at its opening.

7. The glove of claim 6 wherein said storage bag is flexible.

8. The glove of claim 7 wherein said storage bag is affixed to said glove along an outside edge of said glove so that the closure extends along and is parallel to a wearer's hand.

9. The glove of claim 8 wherein said closure extends to the hand opening.

10. A pair of gloves comprising a storage glove and a regular glove, said storage glove including a storage bag being affixed along an outside edge of said glove and positioned to overlie the back of a wearer's hand, said storage glove including an external shell and an inner lining, said storage bag being positioned between said shell and inner liner as said storage bag is stowed.

11. The pair of gloves 10 wherein said storage glove has means for storing itself and the other glove pair member.

12. The pair of gloves of claim 11 wherein said storing means includes a storage bag, and further comprising means for affixing said storage bag to said storage glove so that it may be fitted into the glove or the glove folded into it as desired by the user.

13. The pair of gloves of claim 12 further comprising a closure for sealing said storage bag, said closure being accessible and operable when said storage bag is in either a stowed position or in a storing position.

14. The pair of gloves of claim 13 wherein said closure is a zipper.

* * * * *